United States Patent [19]

Williams

[11] 4,343,303

[45] Aug. 10, 1982

[54] STIMULATING APPARATUS

[76] Inventor: L. Benton Williams, P.O. Box 916, Georgetown, S.C. 29440

[21] Appl. No.: 199,343

[22] Filed: Oct. 21, 1980

[51] Int. Cl.[3] ..... A61H 1/00

[52] U.S. Cl. ..... 128/32; 128/36

[58] Field of Search ..... 128/32, 34, 35, 36, 128/41-46, 48, 49, 51, 52, 55, 67, 76 R, 78

[56] References Cited

U.S. PATENT DOCUMENTS

| | | | |
|---|---|---|---|
| 1,940,904 | 12/1933 | Dayton et al. | 128/78 |
| 3,070,090 | 12/1962 | Taylor | 128/75 |
| 3,478,736 | 11/1969 | Roberts et al. | 128/36 |
| 3,557,781 | 1/1971 | Kaye | 128/32 X |
| 3,812,848 | 5/1974 | Kollitz | 128/36 |

*Primary Examiner*—Richard C. Pinkham

*Assistant Examiner*—T. Brown

*Attorney, Agent, or Firm*—Jacobi, Siegel, Presta, Marzullo & Aronson

[57] ABSTRACT

Apparatus for applying vibratory treatment to selected body regions, such as the cervical or lumbar regions, for the purpose of stimulating muscle activity in these regions. The apparatus comprises a single unit or two assembled units with a vibrating or stimulating device located on each side thereof. The stimulating device may be activated by rechargeable battery or other power source mounted on the unit. The single unit or two assembled units are shaped to conform generally with the selected body region to be treated and only partially surround the body region for the purpose of allowing freedom of movement thereof.

8 Claims, 8 Drawing Figures

FIG.1
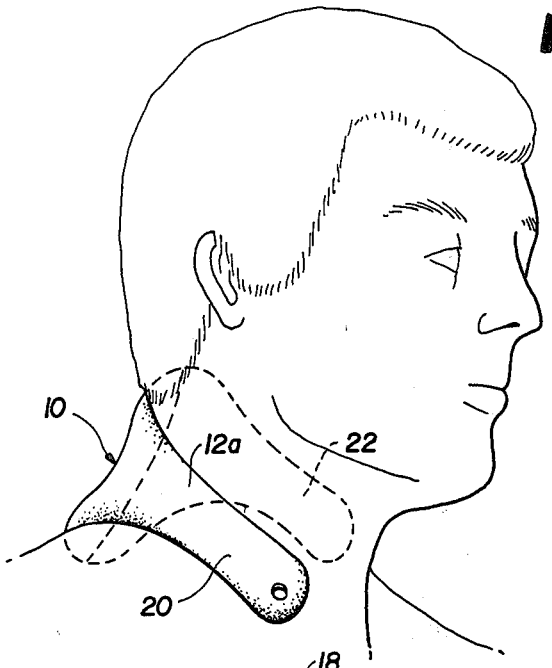
FIG.2
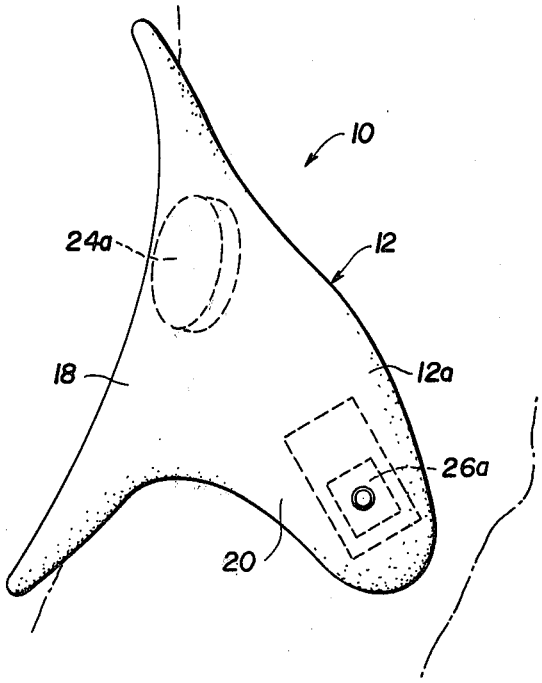
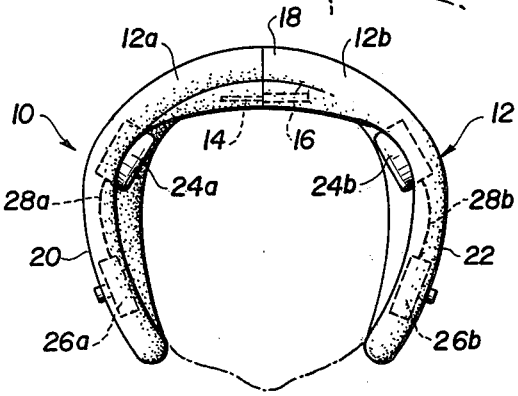
FIG.3
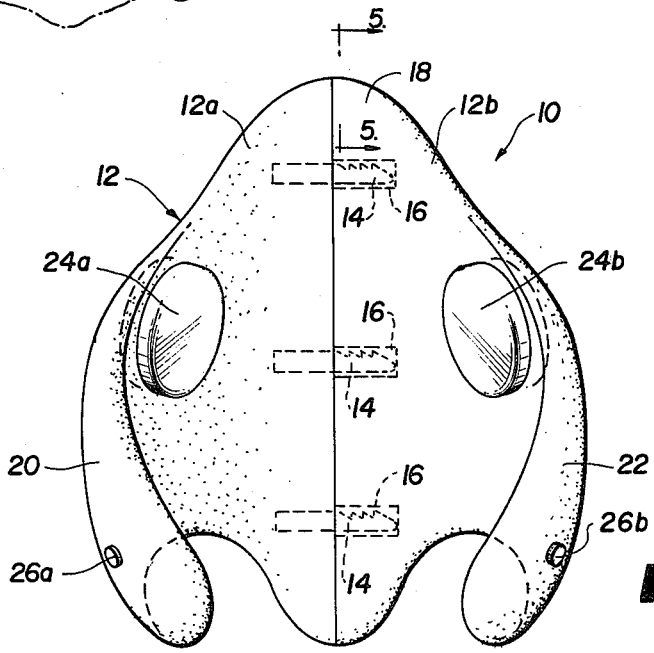
FIG.4

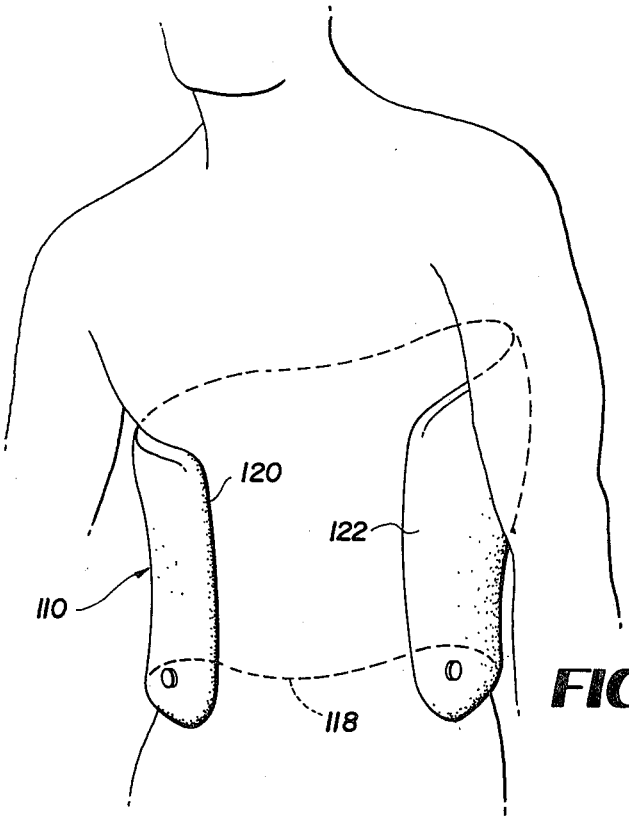
FIG.6
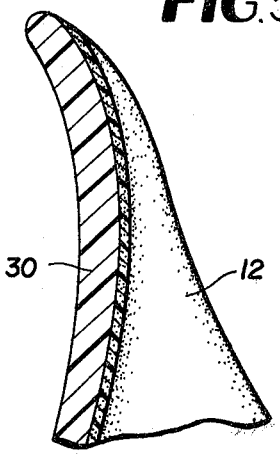
FIG.5
FIG.7
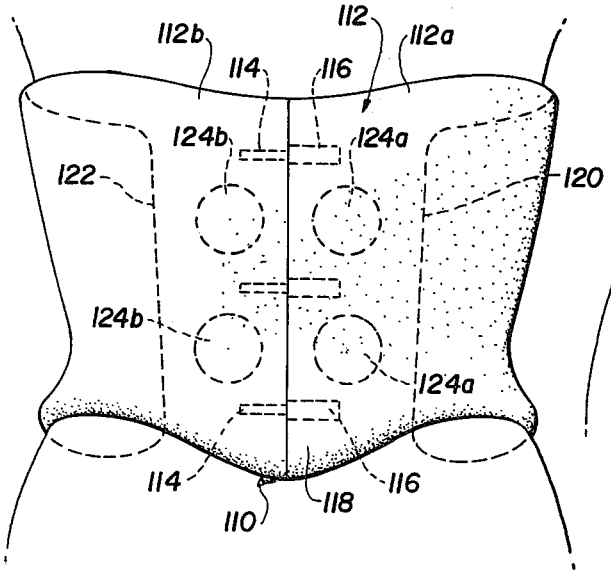
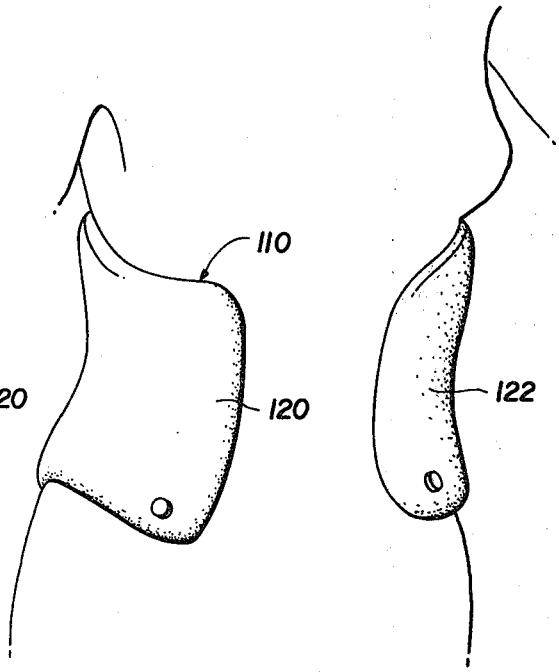
FIG.8

STIMULATING APPARATUS

BACKGROUND OF THE INVENTION

The present invention relates to apparatus for applying vibratory treatment to a selected body region and, more particularly, to such apparatus which conforms in general to the body region to be treated and does not substantially restrict freedom of movement thereof.

It is well known to use vibratory treatment for the purpose of stimulating muscle activity in selected body areas, such as the cervical or lumbar regions. Such vibratory treatment stimulates increased blood supply to the area by constant vibration of the muscles in the area, and is useful in treating acute strain and spasms of the muscles in the area brought on by either tension or injury to the muscles themselves. This stimulation is very helpful in physiotherapy for athletic injuries and automobile accidents, for example, or just plain tension. It may also be very helpful in the treatment of certain muscular areas following surgery.

Although many different types of vibratory apparatus have been used in the past for muscle stimulation of selected body areas, such apparatus has not been entirely satisfactory for one or more of the following reasons:

1. The apparatus has severely restricted body movement;
2. The apparatus has been uncomfortable to wear;
3. It has been necessary to connect the apparatus to a stationary power source so as to restrict the movement of the individual during use of the apparatus;
4. The apparatus has restricted circulation and ventilation in the body area being treated; and
5. The apparatus has been complicated in construction and/or difficult and expensive to manufacture.

Accordingly, a need has arisen for a portable muscular stimulating apparatus that is not subject to any of the above-mentioned disadvantages. The stimulating apparatus of the present invention fulfills this need and, moreover, possesses advantages which are not found in vibratory or stimulating apparatus that has previously been used.

SUMMARY OF THE INVENTION

The present invention is directed to apparatus for applying vibratory treatment to selected body regions, such as the cervical or lumbar regions, for the purpose of stimulating muscle activity in these regions. The apparatus comprises a single unit or two assembled units with a vibrating or stimulating unit device located on each side thereof. The stimulating device may be activated by a rechargeable battery or other portable power source mounted on the unit. The speed of the stimulating device may be variable, with alternating current, and several speeds, levels or degrees. The single unit or two assembled units are shaped to conform generally with the selected body region to be treated and only partially surround the body region for the purpose of allowing freedom of movement thereof.

Preferably, the single unit or two assembled units are formed of a hard plastic material covered with a softer, more flexible material that will fit firmly to the body area being treated. Between the plastic and the body surface, there may be provided a fine-type foam material which will serve to reduce friction rubs or burns caused by the plastic material in the case of body sweating or the like.

BRIEF DESCRIPTION OF THE DRAWINGS

FIG. 1 is a perspective view of the stimulating apparatus of the present invention constructed for treatment of the cervical muscular area of the body, and shows the apparatus mounted in place on the cervical area of a user;

FIG. 2 is a side elevational view of the stimulating apparatus shown in FIG. 1;

FIG. 3 is a top plan view of the stimulating apparatus shown in FIGS. 1 and 2;

FIG. 4 is a front elevational view of the stimulating apparatus shown in FIGS. 1–3;

FIG. 5 is an enlarged sectional view taken substantially along line 5—5 in FIG. 4;

FIG. 6 is a perspective view of a modified form of the stimulating apparatus constructed for application to the lumbar muscular area of the body;

FIG. 7 is a rear elevational view of the stimulating apparatus shown in FIG. 6; and FIG. 8 is a perspective view of a stimulating apparatus of the type shown in FIG. 6, with a modified shape adapted to fit the lumbar muscular area of a female user.

DESCRIPTION OF THE PREFERRED EMBODIMENTS

The stimulating apparatus of the present invention may be formed of a size and shape suitable for treating any selected muscular area of the body. FIGS. 1–5 illustrate a specific form of the stimulating apparatus suitable for treating the cervical muscular area, and FIGS. 6–8 illustrate a second form of the stimulating apparatus suitable for treating the lumbar muscular area.

Referring to FIGS. 1–4, the stimulating apparatus 10 for treating the cervical muscular area comprises a body portion 12 preferably formed of a substantially hard, flexible and resilient plastic material and having a shape generally corresponding with the rear neck area beneath the base of the skull and the sides of the neck area and adjacent shoulder areas. Preferably, the body 12 is formed of two mating sections **12*a* and 12*b*, each defining one side thereof, as shown in FIGS. 3 and 4. The body 12** may also be formed of unitary construction.

The body sections **12*a* and 12*b* may be removably secured together along the rear portions thereof by any suitable means, such as one or more serrated connecting members 14 mounted on the body section 12*a* which are adapted to be received within apertures or slots 16 in the other body section 12*b* and to removably engage a catch (not shown) therein of any suitable type, as generally shown in broken lines in FIGS. 3 and 4**.

When the body sections **12*a* and 12*b* are assembled, or if the body 12 is formed of unitary construction, it generally comprises a curved elongated rear portion 18 corresponding in shape to the rear neck portion and extending generally from the base of the skull downwardly to the area of about the second thoracic vertebra, which is about two inches below the neck. The rear body portion 18 merges on each side with wing portions 20, 22, each of which extends up and over the adjacent shoulder portion to approximately the edge of the clavicle in the manner shown in FIG. 1. Because of the flexibility and resiliency of the body sections 12*a* and 12*b*, the wing portions 20, 22 serve to removably retain the stimulating apparatus 10 in position for treating the cervical muscular area, without unduly restricting neck movement of the user. The cervical stimulating apparatus 10 of the present invention enables the user to have substantially normal neck movement because the wing portions 20, 22** extend only partially around the sides of the neck area and do not extend over the front of the neck area.

Mounted on or within the interior of the body sections 12*a* and 12*b* are vibrating units 24*a* and 24*b*, respectively, which may be of any suitable type for stimulating muscle activity in the cervical body region. The vibrating units 24*a*, 24*b* are positioned so that they will be disposed adjacent the cervical muscular areas to be treated when the stimulating apparatus is mounted on the cervical body area in the manner shown in FIGS. 1–3.

For the purpose of supplying power to the vibrating units 24*a* and 24*b*, portable power sources 26*a* and 26*b* of any suitable type are mounted on or within the wing portions 20 and 22, respectively, and are connected to the vibrating units 24*a* and 24*b* by wires 28*a* and 28*b* or other connectors mounted within the wing portions. Preferably, the power sources 26*a*, 26*b* are rechargeable batteries. Within the scope of the present invention, these power sources may be located in any suitable portion of the stimulating apparatus 10. It is noted that a single power source could be utilized for both vibrating units, in which case the power source would be mounted on one of the body sections 12*a* or 12*b* and suitable connecting means would be provided on the body sections to electrically connect the power source to the vibrating unit on the other section when the body sections were assembled. Also, suitable switch means (not shown) could be provided on one or both of the body sections 12*a* and 12*b* for the purpose of selectively connecting the power sources to the vibrating units to activate them.

Referring to FIG. 5, the inner surface of the body portion 12 preferably is provided with an inner layer 30 of a relatively soft, porous material such as a fine-type foam material which will serve to reduce friction rubs or burns in the case of body sweating or the like. The plastic material of the body portion 12 may be varied throughout the width and height thereof to provide a harder central area and softer, more flexible edge areas, for example, to further facilitate body movement and prevent friction rubs and the like.

FIGS. 6–8 illustrate a modified form of the stimulating apparatus of the present invention which is constructed for application to the lumbar muscular area of the body. Except for the shape, the stimulating apparatus 110 of FIGS. 6–8 is substantially the same in construction and operation as the stimulating apparatus 10 shown in FIGS. 1–5.

The stimulating apparatus 110 preferably is formed of two body sections 112*a* and 112*b* which, when assembled, define a body portion 112 having a rear portion 118 and forwardly extending wing portions 120 and 122. The body sections 112*a* and 112*b* are provided with releasable connecting means 114, 116, and each preferably has mounted thereon a pair of vibrating units 124*a* and 124*b* which are positioned to be disposed on either side of the spinal area for muscle stimulation when the stimulating apparatus 110 is positioned on the lumbar body region of the user in the manner shown in FIGS. 6–8.

Preferably, the rear portion 118 of the stimulating apparatus 110 generally conforms in shape to the back area of the user and extends from an area below the armpits downwardly to an area adjacent the hip region of the user, in the manner generally shown in FIGS. 6–8. The wing portions 120 and 122 extend forwardly from the rear portion 118 beneath the armpits and around the side portions of the chest area to an extent sufficient to retain the stimulating apparatus 110 in position around the lumbar area of the user. In the case of a woman user, the wing portions 120 and 122 extend downwardly beneath the breast area in the manner shown in FIG. 8.

Because the wing portions 120 and 122 extend only partially around the chest area, the stimulating apparatus 110 does not substantially restrict freedom of movement of the body area of the user on which the apparatus is positioned. Also, to provide greater freedom of movement, the apparatus 110 may be formed of a relatively hard plastic material around the beltline area and of a softer plastic material above and below the beltline area in accordance with the teachings of the present invention.

From the foregoing description, it will be readily seen that the stimulating apparatus of the present invention may be comfortably worn while in use, is self-supporting on the selected body portion of the user, and allows substantial freedom of movement of the user while in use.

What is claimed is:

1. Apparatus for stimulating muscle activity in a selected body area, comprising:

a body portion formed of a flexible and resilient, substantially hard plastic material having an inner layer of a soft, porous material and having a shape generally corresponding to the selected body area, said body portion being constructed to extend only partially around the selected body area to an extent sufficient to be self-supporting thereon and to allow freedom of movement of the selected body area when said body portion is mounted thereon, the hardness of the plastic material being varied in said body portion to facilitate movement of the body area on which it is mounted and the self-supporting of the body portion thereon, vibrating means mounted on said body portion for stimulating muscle activity in the selected body area when said body portion is mounted thereon, and portable power means mounted on said body portion and connected to said vibrating means.

2. The apparatus of claim 1 wherein said body portion is formed of two mating sections having releasable connecting means.

3. The apparatus of claim 2 wherein said vibrating means are mounted on each of said body sections, and said power means is mounted on one of said body sections.

4. The apparatus of claim 2 wherein said body sections are constructed to mate along the rear portions thereof, and said releasable connecting means are mounted on said rear portions thereof.

5. The apparatus of claim 1 wherein said body portion comprises a rear portion and wing portions extending forwardly from the sides thereof, said wing portions being of a length sufficient to support said body portion on the selected body area, the ends of said wing portions being spaced from each other a sufficient distance to allow substantial freedom of movement of the selected body area.

6. The apparatus of claim 1 wherein said power means is a rechargeable power cell.

7. The apparatus of claim 1 wherein said vibrating means and said power means are removably mounted on said body portion.

8. The apparatus of claim 1 wherein said vibrating means and said power means are embedded within said body portion.

* * * * *